US009132842B2

(12) United States Patent
Brown

(10) Patent No.: US 9,132,842 B2
(45) Date of Patent: Sep. 15, 2015

(54) FUEL SUPPLY ARRANGEMENT

(71) Applicant: Caterpillar Inc., Peoria, IL (US)

(72) Inventor: Cory A. Brown, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 292 days.

(21) Appl. No.: 13/710,984

(22) Filed: Dec. 11, 2012

(65) Prior Publication Data

US 2014/0158224 A1 Jun. 12, 2014

(51) Int. Cl.

| | |
|---|---|
| ***A01M 7/00*** | (2006.01) |
| ***B60P 3/30*** | (2006.01) |
| ***E01H 1/10*** | (2006.01) |
| ***F16K 17/00*** | (2006.01) |
| ***F16K 31/12*** | (2006.01) |
| ***F16K 31/36*** | (2006.01) |
| ***E03B 11/00*** | (2006.01) |
| ***F17D 1/00*** | (2006.01) |
| ***B61C 17/02*** | (2006.01) |

(52) U.S. Cl.

CPC ..... *B61C 17/02* (2013.01); *Y10T 137/6858* (2015.04); *Y10T 137/6866* (2015.04); *Y10T 137/6873* (2015.04); *Y10T 137/7727* (2015.04); *Y10T 137/7784* (2015.04); *Y10T 137/7785* (2015.04)

(58) Field of Classification Search

CPC ..... B61C 17/02

USPC ..... 137/68.14, 345, 347, 349, 460, 464, 137/466, 497, 498, 500, 503, 572; 213/2, 3; 105/26.05, 62.1, 231

See application file for complete search history.

(56) References Cited

U.S. PATENT DOCUMENTS

| | | | | |
|---|---|---|---|---|
| 3,603,079 | A * | 9/1971 | Kickbusch | 60/608 |
| 3,729,020 | A * | 4/1973 | Koci et al. | 137/522 |
| 4,128,105 | A | 12/1978 | Follett | |
| 4,232,696 | A * | 11/1980 | Burris et al. | 137/62 |
| 5,081,977 | A * | 1/1992 | Swenson | 123/527 |
| 5,109,884 | A * | 5/1992 | du Plessis | 137/460 |
| 5,265,844 | A | 11/1993 | Westfall | |
| 5,887,567 | A | 3/1999 | White et al. | |
| 7,469,718 | B2 | 12/2008 | Lambert et al. | |
| 7,686,037 | B2 | 3/2010 | Krywitsky | |
| 8,047,224 | B2 | 11/2011 | Eichler | |
| 2006/0038401 | A1 | 2/2006 | Kleinbeckel et al. | |
| 2011/0297126 | A1 * | 12/2011 | Akagi et al. | 123/457 |
| 2012/0006416 | A1 | 1/2012 | Lubawy | |
| 2013/0199616 | A1 * | 8/2013 | Van Tassel | 137/1 |

FOREIGN PATENT DOCUMENTS

JP 2000170938 6/2000

* cited by examiner

*Primary Examiner* — John K Fristoe, Jr.
*Assistant Examiner* — Kelsey Rohman
(74) *Attorney, Agent, or Firm* — Miller, Matthias & Hull LLP

(57) ABSTRACT

A fuel supply arrangement adapted for use with a locomotive system. The fuel supply arrangement includes a flow line to supply the fuel from a tender car to an engine car. Further, a quick disconnect coupling is provided on the flow line. A first control system is provided on the flow line configured to stop the supply of the fuel in an event of breaking of the flow line.

18 Claims, 3 Drawing Sheets

FUEL SUPPLY ARRANGEMENT

TECHNICAL FIELD

The present disclosure relates generally to a fuel supply arrangement, and more particularly related to storing, handling, and safe transfer of fuel from a tender car to an engine car.

BACKGROUND

An efficient and safe system is required for storing, transporting, and dispensing of fuels such as LNG, CNG and their equivalents. U.S. Pat. No. 5,887,567 discloses a system for handling, storing, transporting and dispensing cryogenic fluids, liquid natural gas, compressed natural gas, and their equivalents. A fuel injection system is disclosed for directly injecting LNG into an engine's combustion chamber. Such systems include a railroad system in which a container of fuel is carried on a flat car behind a locomotive and the, e.g. liquid natural gas, is conveyed to the locomotive with appropriate valves, conduits, pumps, and controls. In one aspect a fuel fluid, liquid, or vapor is injected into an intake (e.g., an air intake) of an engine. In one aspect a fueling station is configured to provide services such as dispensing LNG and/or CNG for engines. However, there is still room for improvement in the art.

SUMMARY

In an aspect of the present disclosure, a fuel supply arrangement adapted for use with a locomotive system. The fuel supply arrangement includes a flow line to supply the fuel from a tender car to an engine car. Further, a quick disconnect coupling is provided on the flow line. Furthermore, a first control system is provided on the flow line configured to stop the supply of the fuel in an event of breaking of the flow line.

In another aspect of the present disclosure, the first control system includes an excess flow valve provided on the flow line.

Other features and aspects of this disclosure will be apparent from the following description and the accompanying drawings.

DETAILED DESCRIPTION

Figure 1:
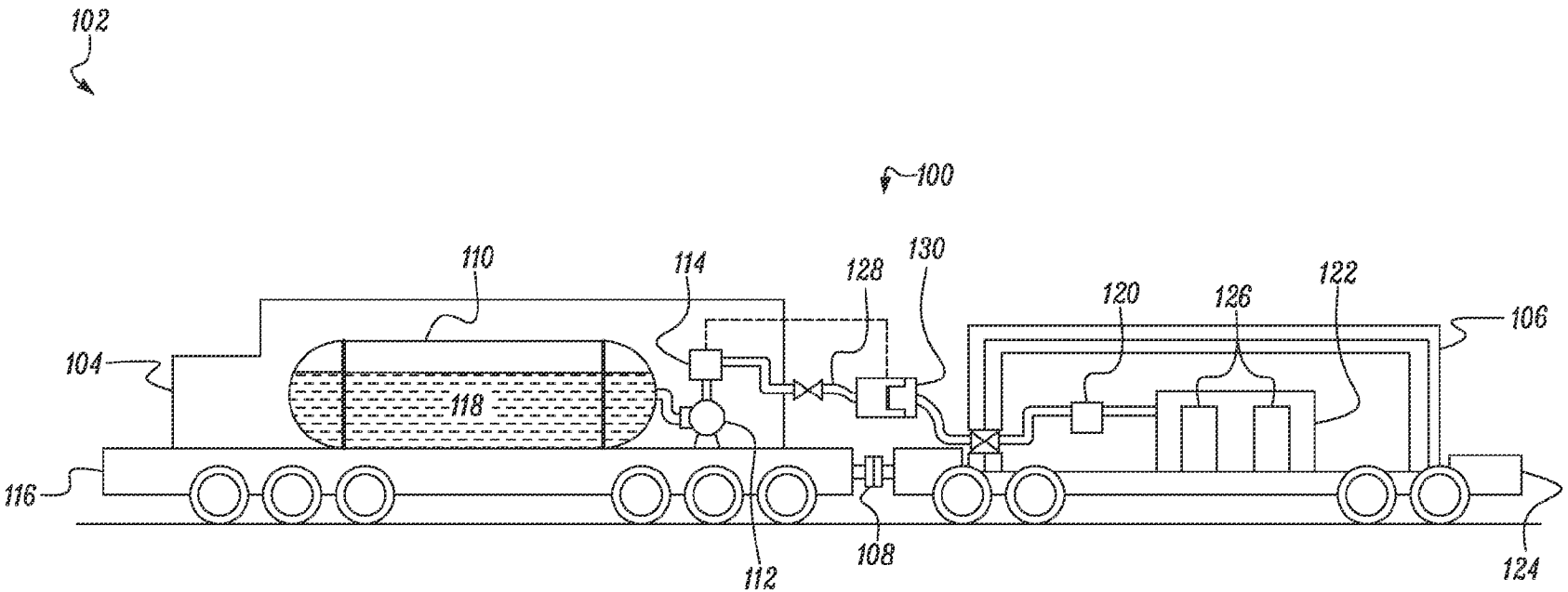
FIG. 1 is a schematic view of a locomotive system illustrating a fuel supply arrangement according to an embodiment of the present disclosure.

FIG. 1 illustrates a fuel supply arrangement 100 in a locomotive system 102, according to an embodiment of the present disclosure. As illustrated, the locomotive system 102 may include a tender car 104 and an engine car 106. In an embodiment of the present disclosure, the tender car 104 may be linked by a mechanical coupler 108 to the engine car 106. In an embodiment of the present disclosure, the tender car 104 may include a tank 110, a pump system 112, and a first control system 114, removably disposed on a first skid frame 116. The tank 110 may be made of for example, but not limited, to a steel body of a standard size ISO tank. The tank 110 may further include plurality of openings and access points for removably connecting various hoses, control valves, etc. The tank 110 may be configured to hold a fuel 118, for example, but not limited to, liquefied natural gas ("LNG"), compressed natural gas ("CNG"), gasoline, diesel and their equivalents. Further, the pump system 112 may be fluidically connected to the tank 110 and provided upstream the first control system 114. The first control system 114 may include at least one of flow meters, control valves, and vaporizers.

Figure 2:
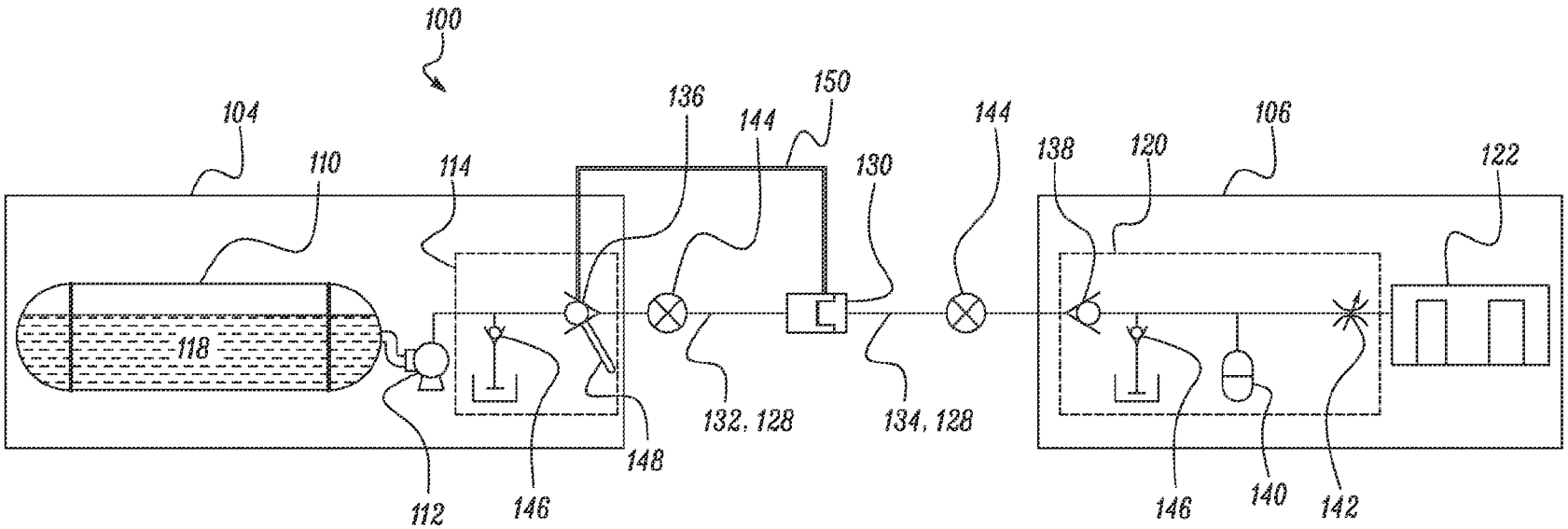
FIG. 2 illustrates a block diagram of fuel supply arrangement.

Referring to FIG. 1, in an aspect of the present disclosure, the engine car 106 may include a second control system 120 and an engine 122 removably disposed on a second skid frame 124. Further, the engine 122 may include plurality of combustion chambers 126. The fuel 118 from the tender car 104 is supplied to the combustion chambers 126 of the engine 122 via one or more flow lines 128. The flow line 128 may be for example a hose, but not limited to, cryogenic hoses. The fuel 118 flows via the flow line 128 from the tank 110 through the first control system 114 to the second control system 120. The second control system 120 may include at least one of valves, accumulators, pump systems or regulators, which is further explained as illustrated in FIG. 2. According to an embodiment of the present disclosure a quick disconnect coupling 130 is provided on the flow line 128. Further, the quick disconnect coupling 130 may send pressure signals to the first control system 114 to stop the supply of the fuel 118 in an event of breaking at the quick disconnect coupling 130.

FIG. 2 illustrates a block diagram of a fuel supply arrangement 100 for transferring the fuel 118 from the tender car 104 to the engine car 106, which embodies the principles of the present disclosure. The fuel supply arrangement 100 may include a tender gas line 132 and an engine gas line 134 as part of the flow line 128. As illustrated, the tender gas line 132 and the engine gas line 134 may be releasably connected by the quick disconnect coupling 130. According to an aspect of present disclosure, the first control system 114 may include an excess flow valve 136 provided on the tender gas line 132. The second control system 120 may include a check valve 138 provided on the engine gas line 134. The check valve 138 may be operated either manually or automatically, which may prevent the fuel 118 from flowing backwards from the engine car 106. A person skilled in the art may understand that, at least one of an accumulator 140 and a regulator 142 may be also provided in the second control system 120. Additionally, one or more shut-off valves 144, and drain valves 146 may be provided on the tender gas line 132 and the engine gas line 134. The shut-off valves 144, and the drain valves 146 may be operated manually or automatically based on any failure in the fuel supply arrangement 100, for example, in the event of leakage or failure in at least one of the tender gas line 132 or the engine gas line 134.

Moreover, a pressure of the fuel 118 is governed by the first control system 114 and the second control system 120 to a desired injection pressure. In an embodiment, the desired injection pressure may be in a range from about 1500-8500 psig. The excess flow valve 136 may be operated automatically to achieve the desired injection pressure in the flow line 128. In an aspect of the present disclosure, a manual release lever 148 may be operatively connected with the excess flow valve 136 to mechanically open the excess flow valve 136 to fill the tender gas line 132 and the engine gas line 134, downstream of the excess flow valve 136, while making a first connection. Further, the manual release lever 148 may be accessed from either inside or outside of the tender car 104. In an alternative aspect of the present disclosure, there may be a bypass line (not shown) that bypasses the excess flow valve 136. In an alternative embodiment, a pressure sensor may be adapted to give feedback signal to the excess flow valve 136, following the excess flow valve 136 may be operated to the open and closed valve configurations based on the sensor readings. As further illustrated in FIG. 2, a pressure feedback line 150 may interconnect the quick disconnect coupling 130 and the excess flow valve 136 of the tender car 104. The excess flow valve 136 may be operated to an open and closed configurations based on the pressure feedback line 150 from the quick disconnect coupling 130 as illustrated in FIGS. 3 and 4.

Figure 3:
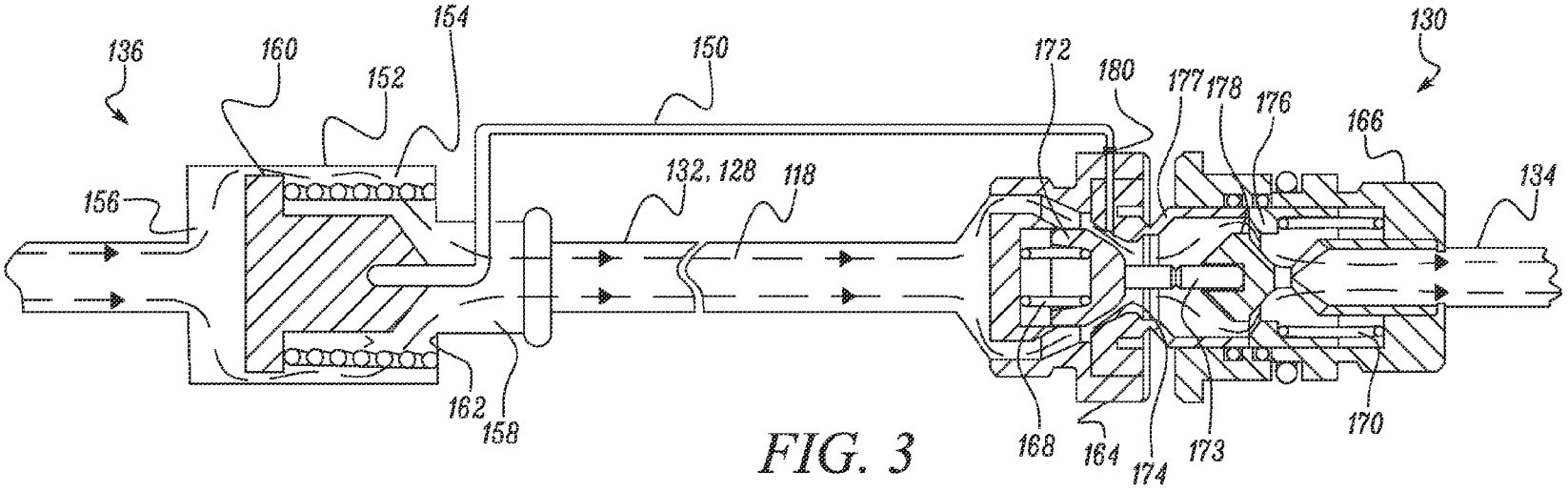
FIG. 3 illustrates an excess flow valve and a quick disconnect coupling in an open configuration, according to an aspect of the present disclosure.
Figure 4:
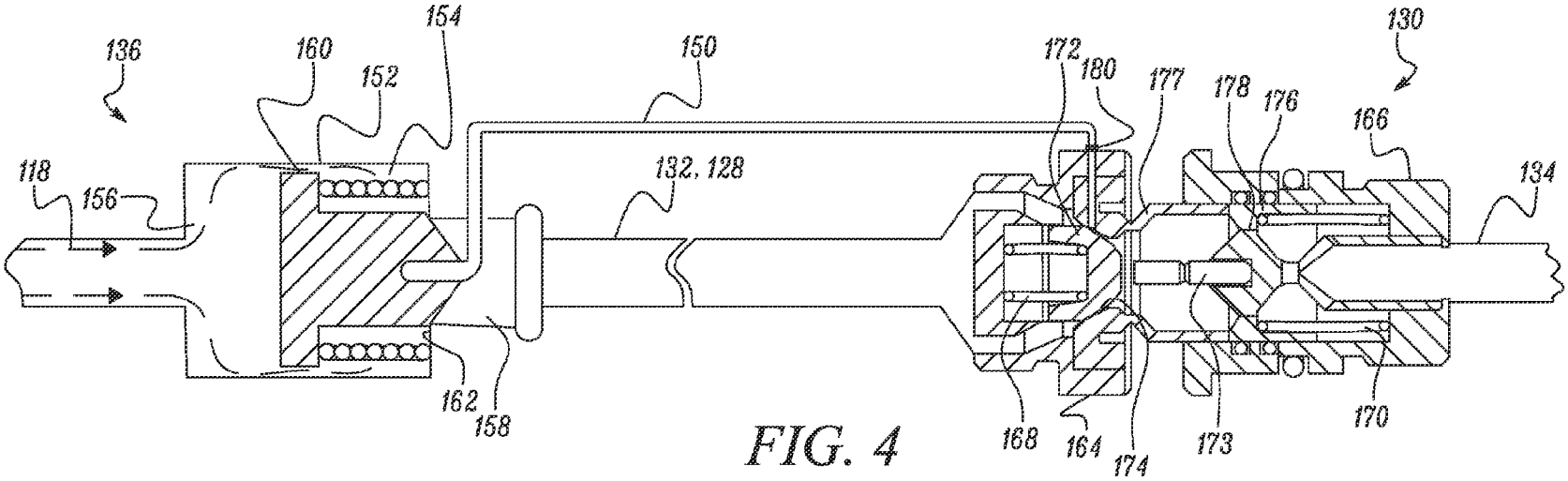
FIG. 4 illustrates the excess flow valve and the quick disconnect coupling of FIG. 3 in a closed configuration.

FIG. 3 illustrates the excess flow valve 136 and the quick disconnect coupling 130 in an open configuration, according to an aspect of the present disclosure. As illustrated, the excess flow valve 136 may include a valve body 152 which defines a passage 154 for the flow of fuel 118 therethrough. The passage 154 may include an inlet 156 and an outlet 158. The valve body 152 may be constructed, for example, but not limited, to a short brass tube. Further, a closure member 160 is adapted to be movable within the passage 154 toward and away from the outlet 158. In the event of the pressurized state in the quick disconnect coupling 130, the closure member 160 is maintained away from a seat portion 162 of the outlet 158, allowing the flow of fuel 118. In the event of low pressure in the quick disconnect coupling 130, the closure member 160 is configured to be in contact with the seat portion 162, restricting the flow of fuel 118.

Moreover, the quick disconnect coupling 130 may include a male coupler 164 and a female coupler 166 which are designed to automatically seal the flow of fuel 118 from the tender car 104 to the engine car 106, in case of a disconnection. The male coupler 164 and the female coupler 166 may be configured to be interconnected with the tender gas line 132 and the engine gas line 134 respectively, for example, but not limited to, by a means of threaded coupling. Further, each of the male coupler 164 and the female coupler 166 include a spring operated valve configuration which automatically closes the flow of fuel 118 therethrough. As illustrated in FIG. 3, both the male coupler 164 and the female coupler 166 include a pair of springs, a first spring 168 and a second spring 170 in the female coupler 166. In the open state of the quick disconnect coupling 130, the first spring 168 associated with a first poppet 172 is compressed by a closure member 173 of the female coupler 166 to move the first poppet 172 away from a first closure interface 174. The second spring 170 associated with a second poppet 176 is compressed by a casing member 177 of the male coupler 164 to move the second poppet 176 away from a second closure interface 178. Further, the quick disconnect coupling 130 may include pressure ports 180 provided to measure the pressure and feedback to the excess flow valve 136 via the pressure feedback line 150. However, it will be apparent to a person having ordinary skill in the art that the quick disconnect coupling 130 as illustrated in FIG. 3 and disclosed above is exemplary in nature and the present disclosure may embody various other quick coupling arrangements having varying construction based on the application and design requirements.

INDUSTRIAL APPLICABILITY

The present disclosure relates to a fuel supply arrangement for safe and effective transfer of fuel 118, from the tender car 104 to the engine car 106 as illustrated in FIG. 2, which embodies the principles of the present disclosure. In a typical sequence of operation, the fuel 118 is pumped to the required fuel pressure, vaporized, metered in the first control system 114 and delivered from the tank 110 to the engine 122. As illustrated in FIG. 2, the excess flow valve 136 may be operated in closed and open configurations, based on the pressure feedback line 150 from the quick disconnect coupling 130. Further, the pressure port 180 may send the pressure signals via the pressure feedback line 150 to the excess flow valve 136.

Referring to FIG. 3, in the event of the pressurized state in the quick disconnect coupling 130, the closure member 160 in the excess flow valve 136 is maintained away from the seat portion 162 allowing a free flow of fuel 118 through the valve body 152. In the open state of the quick disconnect coupling 130, the first spring 168 associated with the first poppet 172 is compressed by the closure member 173 of the female coupler 166 to move the first poppet 172 away from the first closure interface 174. Further, the second spring 170 associated with the second poppet 176 is compressed by the casing member 177 of the male coupler 164 to move the second poppet 176 away from the second closure interface 178 providing free flow of fuel 118 through the valve body 152.

FIG. 4 illustrates the excess flow valve 136 and the quick disconnect coupling 130 of FIG. 3 in a closed configuration. In an event, when the male coupler 164 and the female coupler 166 of the quick disconnect coupling 130 are disconnected, the closure member 173 and the casing member 177 move away from the first poppet 172 and the second poppet 176, respectively. Subsequently, the first spring 168 extends from the compressed state allowing the first poppet 172 to push against the first closure surface 174. Further, the second spring 170 associated with the second poppet 176 extends from the compressed state to push the second poppet 176 to push against the second closure surface 178. Thus, sealing the flow of fuel in the flow line 128. The disconnection or breakage of the quick disconnect coupling 130 may also reduce the pressure in the pressure feedback line 150 allowing the closure member 160 of the excess flow valve 136 to push against the seat portion 162, which effectively blocks the flow of fuel 118 through the passage 154 in the valve body 152. In an embodiment, the low pressure in the pressure feedback line 150 allows a spring to push the closure member 160 against the seat portion 162 to close the excess flow valve 136.

In another aspect of the present disclosure, the check valve 138 present in the engine gas line 134 may prevent the fuel 118 from flowing out of the engine car 106 in event of failure. Further, the shut-off valve 144 provided in the tender gas line 132 and/or or the engine gas line 134 may stop the flow of fuel 118 in an event of failure in the flow line 128. The drain valve 146 present in at least one of the tender gas line 132 and/or the engine gas line 134 may release excess or unwanted quantities of liquid or gas from the tender gas line 132 or the engine gas line 134. Further, the drain valve 146 may be set manually or automatically opened, when a set pressure or temperature is reached. When the drain valve 146 is opened, liquid or air drains from the flow line 128, i.e., tender gas line 132 or the engine gas line 134 due to gravity or pressure differential.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A fuel supply arrangement for transferring a fuel from a tender car to an engine car, the fuel system arrangement comprising:

a flow line to supply the fuel from the tender car to the engine car;

a quick disconnect coupling provided on the flow line, the quick disconnect coupling including a first poppet and a second poppet, the second poppet disposed downstream of the first poppet, the first poppet moveable between a first poppet open position and a first poppet closed position that blocks a pressure feedback line, the second poppet moveable between a second poppet open position and a second poppet closed position that blocks the flow of fuel out of the quick disconnect coupling;

a first control system provided on the flow line configured to stop the supply of the fuel in an event of breaking of the flow line, the first control system disposed upstream of the quick disconnect coupling, the first control system including an excess flow valve having an open position and a closed position; and the pressure feedback line interconnecting the quick disconnect coupling and the excess flow valve, wherein the excess flow valve, the flow line and the quick disconnect coupling collectively define a portion of a fuel flow path between the tender car and the engine car, and the first and second poppets are entirely disposed in the portion of the fuel flow path, wherein further, the excess flow valve is in the closed position when the second poppet is in the second poppet closed position and the pressure feedback line is blocked by the first poppet.

2. The fuel supply arrangement of claim 1, wherein the flow line includes a tender gas line and an engine gas line such that the quick disconnect coupling is provided between the tender gas line and the engine gas line.

3. The fuel supply arrangement of claim 2, wherein the excess flow valve is provided on the tender gas line.

4. The fuel supply arrangement of claim 2, further including a second control system provided on the engine gas line.

5. The fuel supply arrangement of claim 4, wherein the second control system includes a check valve.

6. The fuel supply arrangement of claim 2, further including a shut-off valve provided on at least one of the tender gas line and the engine gas line.

7. The fuel supply arrangement of claim 2, further including a drain valve provided on at least one of the tender gas line and the engine gas line.

8. The fuel supply arrangement of claim 1, wherein the flow line includes at least one of an accumulator and a regulator.

9. A locomotive system comprising:

an engine car;

a tender car linked by a mechanical coupler to the engine car;

and a fuel supply arrangement for transferring a fuel from the tender car to the engine car, the fuel system arrangement including:

a flow line to supply the fuel from the tender car to the engine car;

a quick disconnect coupling provided on the flow line, the quick disconnect coupling including a first poppet and a second poppet, the second poppet disposed downstream of the first poppet, the first poppet moveable between a first poppet open position and a first poppet closed position that blocks a pressure feedback line, the second poppet moveable between a second poppet open position and a second poppet closed position that blocks the flow of fuel out of the quick disconnect coupling;

a first control system provided on the flow line configured to stop the supply of the fuel in an event of breaking of the flow line, the first control system disposed upstream of the quick disconnect coupling, the first control system including an excess flow valve having an open position and a closed position; and the pressure feedback line interconnecting the quick disconnect coupling and the excess flow valve, wherein the excess flow valve, the flow line and the quick disconnect coupling collectively define a portion of a fuel flow path between the tender car and the engine car, and the first and second poppets are entirely disposed in the portion of the fuel flow path, wherein further, the excess flow valve is in the closed position when the second poppet is in the second poppet closed position and the pressure feedback line is blocked by the first poppet.

10. The locomotive system of claim 9, wherein the flow line includes a tender gas line and an engine gas line such that the quick disconnect coupling is provided between the tender gas line and the engine gas line.

11. The locomotive system of claim 10, wherein the excess flow valve is provided on the tender gas line.

12. The locomotive system of claim 10, further including a second control system provided on the engine gas line.

13. The locomotive system of claim 12, wherein the second control system includes a check valve.

14. The locomotive system of claim 10, further including a shut-off valve provided on at least one of the tender gas line and the engine gas line.

15. The locomotive system of claim 10, further including a drain valve provided on at least one of the tender gas line and the engine gas line.

16. The locomotive system of claim 9, wherein the flow line includes at least one of an accumulator and a regulator.

17. A tender car system for a locomotive system, the tender car system comprising:

a tank;

a flow line fluidically connected to the tank;

a quick disconnect coupling provided on the flow line, the quick disconnect coupling including a first poppet and a second poppet, the second poppet disposed downstream of the first poppet, the first poppet moveable between a first poppet open position and a first poppet closed position that blocks a pressure feedback line, the second poppet moveable between a second poppet open position and a second poppet closed position that blocks the flow of fuel out of the quick disconnect coupling;

an excess flow valve provided on the flow line configured to stop the supply of the fuel in an event of breaking of the flow line, the excess flow valve having an open position and a closed position; and the pressure feedback line interconnecting the quick disconnect coupling and the excess flow valve, wherein the excess flow valve, the flow line and the quick disconnect coupling collectively define a portion of a fuel flow path, and the first and second poppets are entirely disposed in the portion of the fuel flow path, wherein further, the excess flow valve is in the closed position when the second poppet is in the second poppet closed position and the pressure feedback line is blocked by the first poppet.

18. The tender car system of claim 17, further including a shut-off valve provided on the flow line.

* * * * *